US009879912B2

(12) United States Patent
Yamamoto et al.

(10) Patent No.: US 9,879,912 B2
(45) Date of Patent: Jan. 30, 2018

(54) HEAT TREATMENT APPARATUS

(75) Inventors: Hirotami Yamamoto, Yokohama (JP); Yuuki Endou, Yokohama (JP); Ryosuke Koizumi, Yokohama (JP)

(73) Assignee: MITSUBISHI HEAVY INDUSTRIES ENVIRONMENTAL & CHEMICAL ENGINEERING CO., LTD., Yokohama-shi (JP)

( * ) Notice: Subject to any disclaimer, the term of this patent is extended or adjusted under 35 U.S.C. 154(b) by 182 days.

(21) Appl. No.: 14/239,939

(22) PCT Filed: Dec. 21, 2011

(86) PCT No.: PCT/JP2011/079654

§ 371 (c)(1),
(2), (4) Date: Feb. 20, 2014

(87) PCT Pub. No.: WO2013/042280

PCT Pub. Date: Mar. 28, 2013

(65) Prior Publication Data

US 2014/0186787 A1 Jul. 3, 2014

(30) Foreign Application Priority Data

Sep. 21, 2011 (JP) ..... 2011-206226

(51) Int. Cl.
*F27B 7/02* (2006.01)
*F27B 7/08* (2006.01)
(Continued)

(52) U.S. Cl.
CPC ..... *F27B 7/08* (2013.01); *F27B 7/02* (2013.01); *F27B 7/14* (2013.01); *F27B 7/22* (2013.01);
(Continued)

(58) Field of Classification Search
CPC ..... F27B 2007/2266; F27B 2007/2226; F27B 7/2206; F27B 7/08; F27B 7/02; F27B 7/22; F27B 7/14; F27B 7/24; F27D 99/0073
(Continued)

(56) References Cited

U.S. PATENT DOCUMENTS 3,572,859 A * 3/1971 Sommer ..... F27B 7/22 384/549
4,087,334 A * 5/1978 Harig ..... B01J 2/12 165/89
(Continued)

FOREIGN PATENT DOCUMENTS

FR 2 366 498 A1 4/1978
FR 2 331 757 A1 6/1997
(Continued)

OTHER PUBLICATIONS

Extended European Search Report dated Apr. 28, 2015, issued in corresponding Application No. 11872687.6 (7 pages).
(Continued)

*Primary Examiner* — Alissa Tompkins
*Assistant Examiner* — Benjamin W Johnson
(74) *Attorney, Agent, or Firm* — Westerman, Hattori, Daniels & Adrian, LLP

(57) ABSTRACT

A heat treatment apparatus for performing heat treatment of treatment objects inside a cylindrical body by heating the cylindrical body and rotating the cylindrical body around an axis, includes a pair of movable support parts provided on opposite ends of the cylindrical body along the axis of the cylindrical body so as to be able to move along the axis and rotatably support the cylindrical body around the axis, and a fixed support part provided between the pair of the movable support parts along the axis so as to be unable to
(Continued)

move along the axis and rotatably support the cylindrical body around the axis. The cylindrical body is supported by a three-point support of the pair by the movable support parts and the fixed support part.

7 Claims, 6 Drawing Sheets

(51) Int. Cl.
*F27B 7/14* (2006.01)
*F27B 7/22* (2006.01)
*F27B 7/24* (2006.01)
*F27D 99/00* (2010.01)

(52) U.S. Cl.
CPC ..... *F27B 7/2206* (2013.01); *F27B 7/24* (2013.01); *F27D 99/0073* (2013.01)

(58) Field of Classification Search
USPC ..... 432/106, 112, 115, 116
See application file for complete search history.

(56) References Cited

U.S. PATENT DOCUMENTS

| | | | | |
|---|---|---|---|---|
| 4,344,596 | A | 8/1982 | Hjaeresen | |
| 5,695,329 | A * | 12/1997 | Orcutt | F27B 7/28 110/246 |
| 2002/0022209 | A1* | 2/2002 | Polino | F27B 7/24 432/115 |
| 2011/0065058 | A1* | 3/2011 | Kumagai | F27B 7/20 432/112 |

FOREIGN PATENT DOCUMENTS

| | | | |
|---|---|---|---|
| JP | 55-152378 | A | 11/1980 |
| JP | 9-217988 | A | 8/1997 |
| JP | 10-300356 | A | 11/1998 |
| JP | 11-14264 | A | 1/1999 |
| JP | 3101264 | B1 | 10/2000 |
| JP | 2005030609 | A | 2/2005 |
| JP | 2006-57939 | A | 3/2006 |
| JP | 2008-8600 | A | 1/2008 |
| JP | 2008-180451 | A | 8/2008 |
| JP | 2008-256287 | A | 10/2008 |
| JP | 2008298410 | A | 12/2008 |

OTHER PUBLICATIONS

English Abstract and machine translation of JP2008-180451 which was previously submitted in the IDS on Feb. 20, 2014.
Machine translation of JP 3101264 which was previously submitted in the IDS on Feb. 20, 2014.
English Abstract and machine translation of JP2008-8600 which was previously submitted in the IDS on Feb. 20, 2014.
English translation of Written Opinion dated Mar. 19, 2012, issued in corresonding International Application No. PCT/JP2011/079654, which was previously submitted in the IDS on Feb. 20, 2014.
International Search Report dated Mar. 19, 2012 issued in corresponding application No. PCT/JP2011/079654.
Japanese Office Action dated Aug. 25, 2015, issued in corresponding JP Patent Application No. 2011-206226, with English translation (6 pages).
Decision to Grant a European Patent, dated Aug. 19, 2016, issued in counterpart European Patent Application No. 11872687.6. (2 pages).

* cited by examiner

HEAT TREATMENT APPARATUS

TECHNICAL FIELD

The present invention relates to a heat treatment apparatus in which a cylinder rotating around an axis is heated and treatment objects inside the cylinder are subjected to a heat treatment. Priority is claimed on Japanese Patent Application No. 2011-206226, filed Sep. 21, 2011, the contents of which are incorporated herein by reference.

BACKGROUND ART

Conventionally, when performing, for example, drying, heating, and burning of a lime mud, foamable minerals, ceramics raw material powder, or the like, pyrolyzation of a rubber, a plastic waste, or the like, heat treatment or gasification treatment of a sewage sludge, a woody material, or the like, and carbonization of coal, a rotary kiln is widely employed as the heat treatment apparatus.

In a rotary kiln, there is an internal heating rotary kiln which heats directly treatment objects by injecting flame inside a cylindrical body (cylinder), which is supplied the treatment objects, by a burner, and an external heating rotary kiln which heats a cylindrical body from the outside thereof and heats indirectly treatment objects through the cylindrical body. In addition, one of the external heating rotary kiln has an outer cylinder around the inner cylinder (cylindrical body) rotating around an axis, the inner cylinder is heated from the outside thereof by which heating gas flows through the outer cylinder, and the inner cylinder is rotated and performs heat treatment while transferring the treatment objects inside the inner cylinder (for example, refer to Patent Document 1 and Patent Document 2).

In addition, for example, when low calorie materials (treatment objects) such as a sewage sludge, a woody biomass and low grade coal are reformed to carbide having a large calorific value similar to coal by the external heating rotary kiln (an external heating furnace or an external heating carbonization furnace), the inner cylinder is heated to a high temperature of 300 to 800° C., and performs heat treatment to the treatment objects at the condition of which oxygen is excluded. Thermal expansion and bending occurs to the inner cylinder when heated at a high temperature as above. Thus, conventionally, for example, in the inner cylinder, one end side along the axis, which is the inlet port side of the treatment objects, is rotatably supported around the axis by a movable support part, which is able to move along the axis, and the other end side along the axis, which is the outlet port side of the treatment objects, is rotatably supported around the axis by a fixed support part, which is unable to move along the axis, and the inner cylinder is provided so as to absorb the thermal expansion by the moving of the movable support part along the axis.

PRIOR ART DOCUMENTS

Patent Documents

[Patent Document 1] Japanese Unexamined Patent Application, First Publication No. 2008-180451

[Patent Document 2] Japanese Patent Publication No. 3101264

DISCLOSURE OF THE INVENTION

Problems to be Solved by the Invention

As the inner cylinder becomes longer, the amount of the thermal expansion absorbed at the movable support part becomes larger, and the amount of bending in a vertical direction becomes larger. Thus, in a conventional external heating rotary kiln (heating treatment apparatus) as described above, by the occurrence of this thermal expansion and bending, the inner cylinder has a limitation in structure such that the diameter of the inner cylinder is approximately 5 m and the length of the inner cylinder is approximately 20 to 30 m, and therefore, a further increase in size was difficult to achieve.

More specifically, when the inner cylinder is increased in size, the amount of bending increases due to thermal expansion, and thus, the thickness of the inner cylinder is required to be thick accordingly. In addition, conventionally, in the external heating rotary kiln, the temperature of the inner cylinder reaches 300 to 800° C., and thus, an inner cylinder is formed by using a special alloy such as "INCOLOY (registered trademark)" or the like. However, when the thickness of the special alloy exceeds, for example, 40 mm, due to the increase in size, ensuring the mechanical strength of the welded part at high temperature is difficult, and there is a possibility of posing a problem in long-term stable operation.

In addition, when the inner cylinder is increased in size and the amount of bending increases due to thermal expansion, the sealing property of a sliding part between the inner cylinder rotating around the axis and the outer cylinder is difficult to ensure, and there is a possibility of a decrease in heat transfer performance due to an increase in the amount of air leaked.

In addition, when the diameter of the inner cylinder exceeds 5 m, the impact force at the time the treatment objects, which are agitated and mixed inside due to the rotation of the inner cylinder, fall increases. Thus, for example, in the external heating carbonization furnace reforming a low-calorie materials of the treatment objects to carbide having a large calorific value, the particle size reduction of the treatment objects is performed in the inner cylinder, and the amount of carbide accompanied with pyrolytic gas significantly increases. As this result, the yield of produced carbide is reduced, adhesion of dust in a duct of pyrolytic gas and blocking due to the adhesion of the dust occurs, and the amount of fly ash in the exhaust gas of the combusted pyrolytic gas is greatly increased. Furthermore, the amount of ash adhered to the outer surface of the inner cylinder increases, and heat transfer performance decreases.

The filling rate of the treatment objects inside the inner cylinder is normally approximately 10 to 20% and is constant, and when the filling rate is constant as described above, the filling rate of the treatment objects increases when the inner cylinder is increased in size. In addition, heat transfer of the external heating rotary kiln depends on the temperature difference between the inner cylinder heated at a high temperature and the treatment objects, and thus, when the inner cylinder is increased in size, by the increase of the filling height of the treatment objects, the degree of mixing, which is resulted from the agitation by the inner cylinder, significantly decreases, and heat transfer performance is reduced. Therefore, even if the inner cylinder is increased in size, the production efficiency is reduced as a result, and thus, an increase in size does not achieve desired advantages.

Because of the problems as described above, the size of the structure is limited to approximately 5 m of the diameter of the inner cylinder and approximately 20 to 30 m of the length of the inner cylinder, and it is difficult to achieve a further increase in size. Thus, for reforming low-calorie materials to carbide having a calorific value similar to coal or the like, only the external heating rotary kiln in which the maximum amount of treating is approximately 100 t/day has been commercialized at present.

However, in recent years, there is a growing need for reducing greenhouse gases due to rapidly increasing demand for large-scale plants such as coal-fired power plants. In order to meet the growing demands, a method of solving the heat transfer performance problem and the size limitation problem is highly desired.

Means for Solving the Problem

A heat treatment apparatus according to one aspect of the present invention performs heat treatment of treatment objects inside a cylindrical body by heating the cylindrical body rotating around an axis, and the heat treatment apparatus includes a pair of movable support parts provided on both sides along the axis of the cylindrical body so as to be able to move along the axis and rotatably supporting the cylindrical body around the axis, and a fixed support part provided between the pair of the movable support parts along the axis so as to be unable to move along the axis and rotatably supporting the cylindrical body around the axis, wherein the cylindrical body is supported by a three-point support of the pair of the movable support parts and the fixed support part.

In the present invention, both ends side of the cylindrical body are supported by each of the movable support parts, the middle part of the cylindrical body which is between the pair of the movable support parts is supported by the fixed support part, and the cylindrical body is supported by a three-point support mechanism. Accordingly, heat expansion of the cylindrical body occurred between one movable support part of the movable support parts and the fixed support part can be absorbed by the one movable support part, and heat expansion of the cylindrical body occurred between the other movable support part of the movable support parts and the fixed support part can be absorbed by the other movable support part.

In addition, by providing the fixed support in between the movable support parts of the both ends of the cylindrical body, one side of the cylindrical body can be supported by the fixed support part and one movable support part of the movable support parts, the other side of the cylindrical body can be supported by the fixed support part and the other movable support part. Thus, compared with a case of a two-point support, which supports the cylindrical body at both sides along the axis, the present invention can suppress the amount of bending that occurs to the cylindrical body to a small amount.

According to the above, for example, two cylindrical bodies having a length of approximately 20 to 30 m and a diameter of approximately 5 m in which the length and the diameter are compatible in structure and in heat transfer performance of the cylindrical bodies are connected in series, the connecting part is supported by the fixed support part, and both ends of each of cylindrical bodies are supported by the movable support parts. Accordingly, even if the cylindrical body is increased in size, the amount of thermal expansion and the amount of bending can be suppressed to a similar extent to the conventional amount. Thus, without changing the thickness of the cylindrical body and without loss of sealing properties, that is, without leading to a decrease in heat transfer performance, the cylindrical body can realize an increase in size.

In the heat treatment apparatus according to another aspect of the present invention, it is desirable that the movable support parts and the fixed support part rotatably support the cylindrical body with a bearing mechanism.

According to the present invention, by the movable support parts and the fixed support part, the influence of heat transfer can be reduced and the cylindrical body can be rotatably supported around the axis reliably.

Furthermore, in the heat treatment apparatus according to another aspect of the present invention, it is desirable that in an inner surface of the cylindrical body, a heat insulation part suppressing heat transfer from an inside of the cylindrical body to an outside of the cylindrical body is provided in a region in which the fixed support part is provided.

According to the present invention, the temperature of the outer surface of the cylindrical body can be maintained at a low temperature by the heat insulation part. Thus, without being affected by the heat transfer, the cylindrical body can be supported reliably by the fixed support part.

In addition, however, even if the middle part along the axis of the cylindrical body is supported by the fixed support part, by providing the heat insulation part, a lowering of temperature of the inside of the cylindrical body at the part, which supports the cylindrical body by the fixed support part, can be minimized, and a quality loss of the treatment objects inside the cylindrical body can be suppressed. In addition, by suppressing the lowering of temperature of the inside of the cylinder at the part, which supports the cylindrical body by the fixed support, a condensation of tar can be prevented and a trouble caused by a lowering of temperature can be reliably avoided.

In addition, in the heat treatment apparatus according to another aspect of the present invention, it is desirable that the heat insulation part has a stretchable portion configured to be able to stretch along the axis in at least part of the heat insulation along the axis.

According to the present invention, thermal expansion can be absorbed by the movable support parts provided at both ends along the axis of the cylindrical body, and thermal expansion of the cylindrical body can be absorbed by the stretchable portion of the heat insulation part. Thus, thermal expansion of the cylindrical body can be absorbed more reliably and effectively, and the amount of bending that occurs in the cylindrical body can be suppressed to a small amount.

Furthermore, in the heat treatment apparatus according to another aspect of the present invention, the cylindrical body may be configured by two cylindrical members separated into two sections along the axis, and the heat insulation part may be configured by at least two heat insulation members fixed to each of the cylindrical members.

According to the present invention, for example, two cylindrical bodies (cylindrical members) of a conventional rotary kiln having a length of approximately 20 to 30 m and a diameter of approximately 5 m in which the length and the diameter are compatible in structure and in heat transfer performance of the cylindrical bodies are connected in series, the connecting part is supported by the fixed support part, and both ends of each of cylindrical bodies are supported by the movable support parts. Thus, the cylindrical body can be increased in size easily and economically.

In addition, the heat treatment apparatus according to another aspect of the present invention may be an external heating furnace.

According to the present invention, for example, the external heating carbonization furnace, which reforms a low-calorie materials of the treatment-objects to carbide having a large calorific value, such as an external heating furnace (cylindrical body (inner cylinder) of an external heating furnace), can be increased in size without leading to a decrease in heat transfer performance.

Effects of the Invention

According to the heat treatment apparatus of the present invention, both ends side of the cylindrical body are supported by each of the movable support parts, the part of the cylindrical body which is between the pair of the movable support parts is supported by the fixed support part, and the cylindrical body is supported by a three-point support mechanism, thereby, by providing the fixed support part in between the cylindrical bodies, thermal expansion of one side of the cylindrical body and the other side thereof can be absorbed by each of the movable support parts. In addition, compared with a case of a two-point support, which supports the cylindrical body at both ends along the axis, the present invention can suppress the amount of bending occurring in the cylindrical body to a small amount.

Thus, even if the cylindrical body is increased in size, an increase of the amount of thermal expansion and the amount of bending can be suppressed to a similar extent to the conventional amount, and without leading to a decrease in heat transfer performance, the cylindrical body can realize an increase in size.

In addition, the cylindrical body is supported by a three-point support of the pair of the movable support parts and the fixed support part, and the present invention solves problems in structure and in heat transfer performance as described above, and can realize an increase in size. Thus, for example, the external heating carbonization furnace, or the like, which reforms a low-calorie materials of the treatment-objects to carbide having a large calorific value, increases an amount of treatment of the treatment objects, can improve the production rate, and can correspond to the needs of large-scale use, such as in coal-fired power plants.

EMBODIMENTS OF THE INVENTION

Hereinafter, FIGS. 1 to 6 are referred to and a heat treatment apparatus according to one embodiment of the present invention is explained. In addition, the present embodiment is explained by which the heat treatment apparatus of the present invention represents an external heating rotary kiln (an external heating furnace or an external heating carbonization furnace) for which treatment objects, which are low calorie materials such as a sewage sludge, a woody biomass, and low grade coal, are subjected to heat treatment and are reformed to carbide having a large calorific value.

Figure 1:
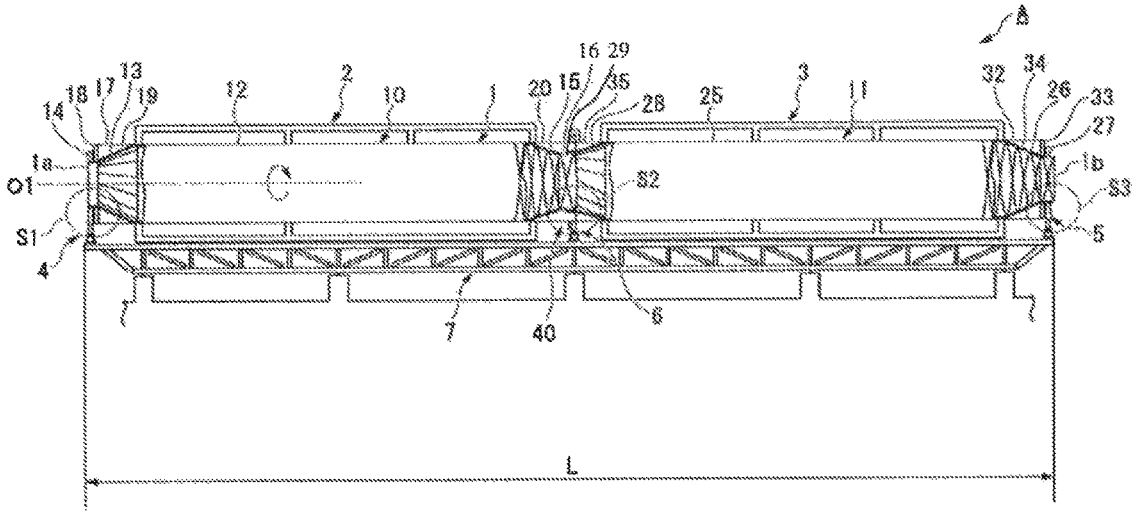
FIG. 1 shows a heat treatment apparatus (external heating rotary kiln) according to one embodiment of the present invention.

The external heating rotary kiln A of the present embodiment, as shown in FIG. 1, is provided with an inner cylinder (cylindrical body) 1, outer cylinders (muffle) 2, 3, two movable support parts 4, 5, a fixed support part 6, and a base 7.

The inner cylinder 1 of the present embodiment is, for example, a cylindrical body having a cylindrical shape in a large size which is approximately 50 m of length L along an axis O1, and with respect to a boundary in the center of the inner cylinder 1 along the axis O1, the inner cylinder 1 is configured by a first cylindrical member 10 provided at one side of the boundary and a second cylindrical member 11 provided at the other side of the boundary. These first and second cylindrical members 10, 11 are the inner cylinders provided in the conventional external heating rotary kiln which has a length of approximately 20 to 30 m and a diameter of approximately 5 m in which the length and the diameter are compatible in structure and in heat transfer performance of the inner cylinder 1. The inner cylinder 1 of the present embodiment is formed by connecting in series two cylindrical members which are the first cylindrical member 10 and the second cylindrical member 11 and which are similar to the conventional inner cylinder. That is, the inner cylinder 1 of the present embodiment is provided with two cylindrical members 10, 11 so that the inner cylinder 1 is separated into two sections along the axis O1. Here, the inner cylinder 1 has a plurality of fins or spirals at the inside thereof which are arranged so as to incline with respect to a circumferential direction of the inner cylinder 1, rotates around the axis O1, and is formed so that the treatment objects fed inside the inner cylinder 1 from an inlet port 1*a* can be sequentially transferred toward an outlet port 1*b*.

In addition, the first cylindrical member 10 is provided with a first cylindrical main body 12, a first conical portion 13, a first minor diameter portion 14, a second conical portion 15, and a second minor diameter portion 16. The first cylindrical main body 12 is formed along the axis O1 and in a substantially constant diameter of, for example, approximately 5 m. The first conical portion 13 is formed at one end of the first cylindrical main body 12 disposed at the inlet port 1*a* side of the inner cylinder 1 so that the diameter of the first conical portion 13 is gradually reduced from the one end of the first cylindrical main body 12 toward the inlet port 1*a*. The first minor diameter portion 14 is formed in a substantially constant diameter at an end of the first conical portion 13 on the inlet port 1*a* side. The second conical portion 15 is formed at the other end of the first cylindrical main body 12 so that the diameter of the second conical portion 15 is gradually reduced from the other end of the first cylindrical main body 12 toward the second cylindrical member 11. The second minor diameter portion 16 is formed with a substantially constant diameter with respect to the axis O1 at an end of the second conical portion 15 on the second cylindrical member 11 side.

Figure 2:
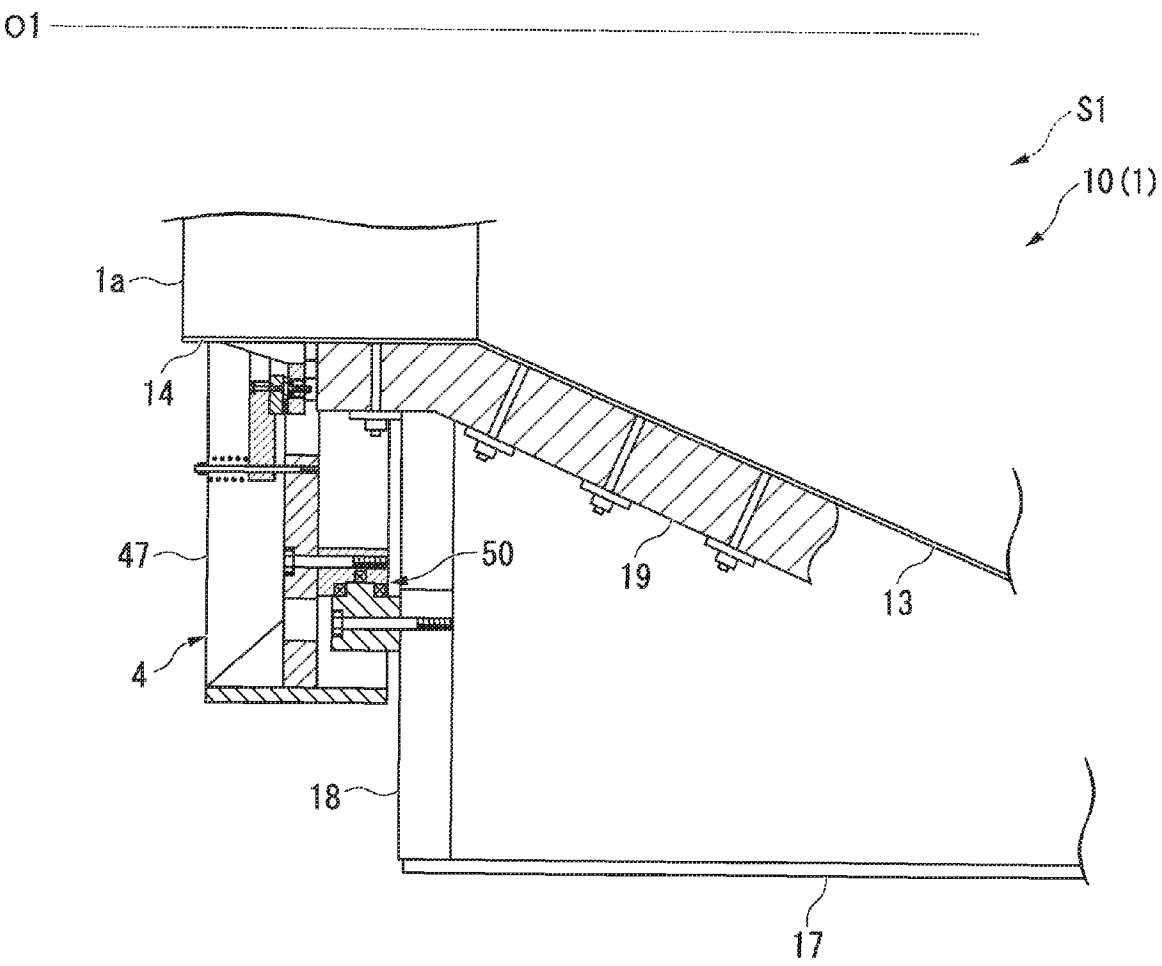
FIG. 2 shows an enlarged view of a portion S1 in FIG. 1.

The first cylindrical member 10 is provided with a first outer shell 17 having a cylindrical shape, and a first blocking plate 18 having an annular shape. The first cylindrical member 10 is formed at the same diameter as the first cylindrical main body 12, and extends toward the inlet port 1*a* side from the one end of the first cylindrical main body 12 so that the first cylindrical member 10 covers the first conical portion 13. The first blocking plate 18 is provided so as to block an opening of the first outer shell 17 on the inlet port 1*a* side. As shown in FIG. 1 and FIG. 2 showing an enlarged view of a portion S1 in FIG. 1, a heat insulation member (heat insulation material) 19 is provided inside a space surrounded by the first outer shell 17, the first conical portion 13, and the first blocking plate 18. In addition, in the present embodiment, this heat insulation member 19 is provided so as to cover an outer circumferential surface of the first conical portion 13.

The first cylindrical member 10 is provided with a second outer shell 20 having a cylindrical shape, and a flange 21 having an annular shape. The second outer shell 20 is formed at the same diameter as the first cylindrical main body 12, and extends toward the second cylindrical member 11 side from the other end of the first cylindrical main body 12 so that the second outer shell 20 covers the second conical portion 15 and the second minor diameter portion 16. The flange 21 is projected to the outside in a radial direction at an end of the second outer shell 20 on the second cylindrical member 11 side, and extends in a circumferential direction of the second outer shell 20.

As shown in FIG. 1, the second cylindrical member 11 is provided with a second cylindrical main body 25, a third conical portion 26, a third minor diameter portion 27, a fourth conical portion 28, and a fourth minor diameter portion 29. The second cylindrical main body 25 is formed along the axis O1 and in a substantially constant diameter of, for example, approximately 5 m. The third conical portion 26 is formed at one end of the second cylindrical main body 25 disposed at the outlet port 1*b* side of the inner cylinder 1 so that the diameter of the second conical portion 26 is gradually reduced from the one end of the second cylindrical main body 25 toward the outlet port 1*b*. The third minor diameter portion 27 is formed in a substantially constant diameter at an end of the third conical portion 26 on the outlet port 1*b* side. The fourth conical portion 28 is formed at the other end of the second cylindrical main body 25 so that the diameter of the fourth conical portion 28 is gradually reduced from the other end of the second cylindrical main body 25 toward the first cylindrical member 10. The fourth minor diameter portion 29 is formed in a substantially cylindrical shape with respect to the axis O1 at an end of the fourth conical portion 28 on the first cylindrical member 10 side.

Figure 3:
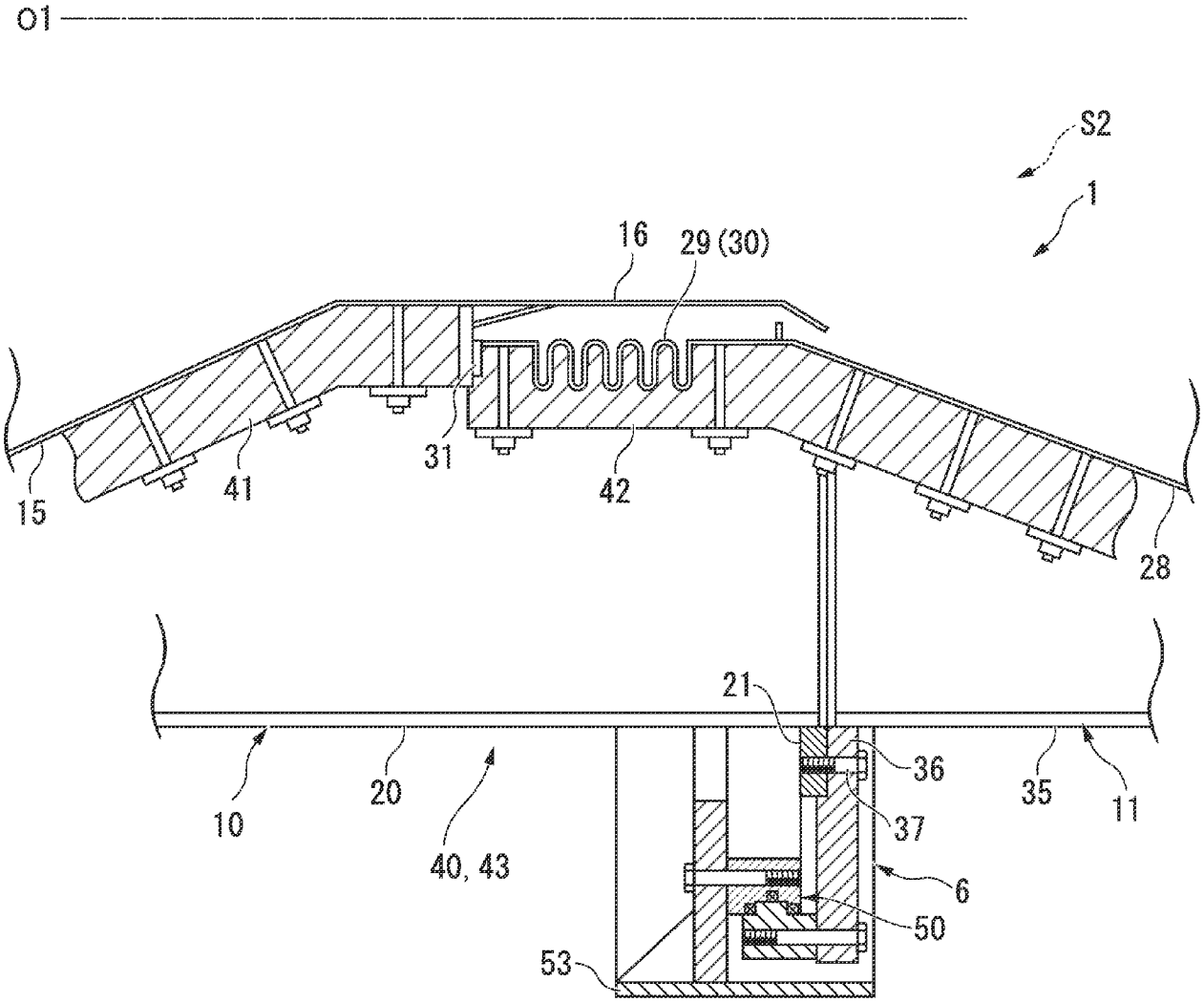
FIG. 3 shows an enlarged view of a portion S2 in FIG. 1.

In addition, the fourth minor diameter portion 29, as shown in FIG. 1 and FIG. 3 showing an enlarged view of a portion S2 in FIG. 1, is formed in a substantially cylindrical shape having a wavy shape, and this wavy shape part is a stretchable portion 30 which can stretch along the axis O1 of the inner cylinder 1. Furthermore, a connection flange 31 having an annular shape is projected to the outside in a radial direction at an end of the fourth minor diameter portion 29 on the first cylindrical member 10 side, and extends in a circumferential direction of the fourth minor diameter portion 29.

Figure 4:
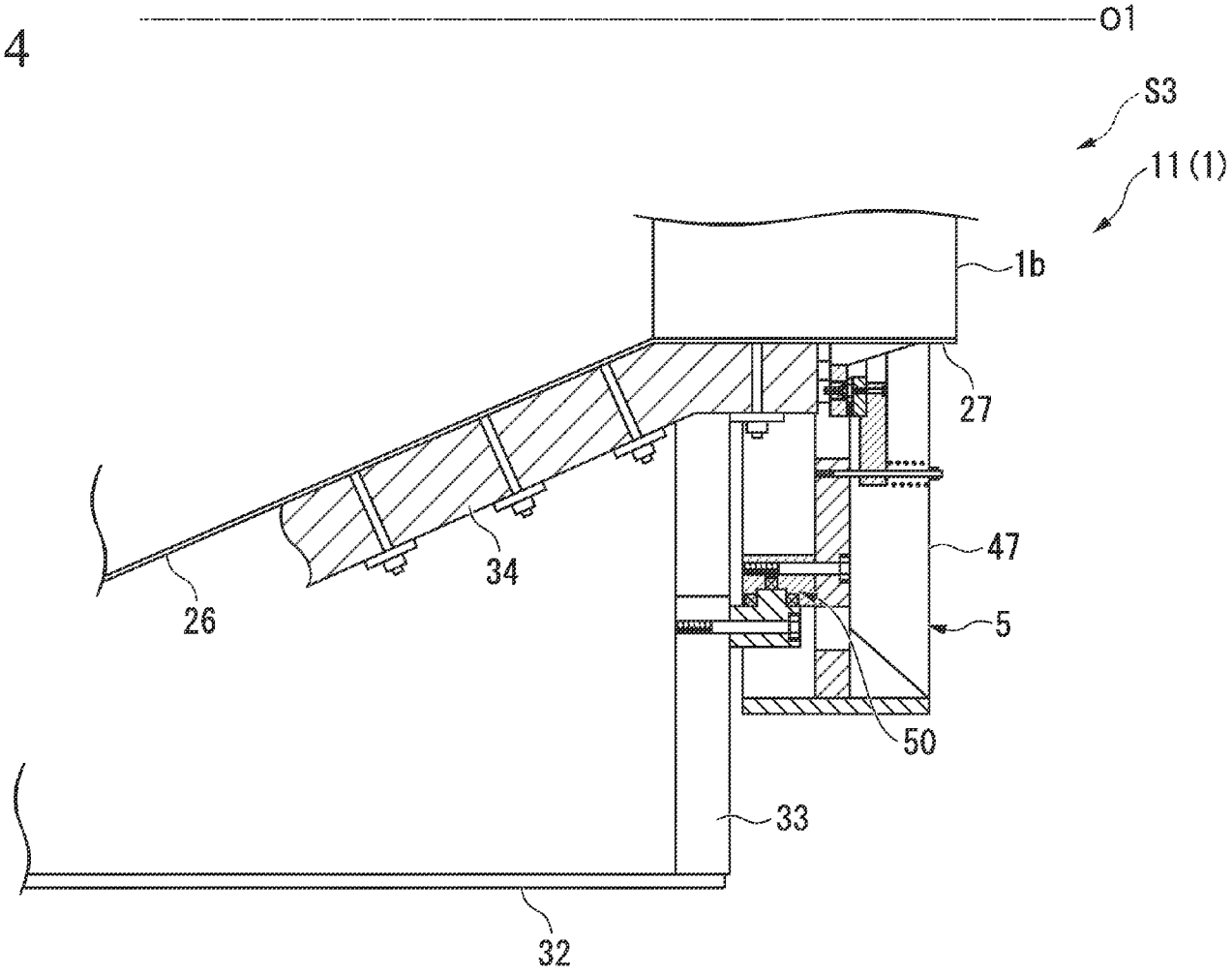
FIG. 4 shows an enlarged view of a portion S3 in FIG. 1.

In addition, as shown in FIG. 1 and FIG. 4 showing an enlarged view of a portion S3 in FIG. 1, the second cylindrical member 11 is provided with a third outer shell 32 having a cylindrical shape, and a second blocking plate 33 having an annular shape. The third outer shell 32 is formed at the same diameter as the second cylindrical main body 25, and extends toward the outlet port 1*b* side from the one end of the second cylindrical main body 25 so that the third outer shell 32 covers the third conical portion 26. The second blocking plate 33 is provided so as to block an opening of the third outer shell 32 on the outlet port 1*b* side. A heat insulation member (heat insulation material) 34 is provided inside a space surrounded by the third outer shell 32, the third conical portion 26, and the second blocking plate 33. In addition, in the present embodiment, this heat insulation member 34 is provided so as to cover an outer circumferential surface of the third conical portion 26.

Furthermore, as shown in FIG. 1 and FIG. 3 showing an enlarged view of a portion S2 in FIG. 1, the second cylindrical member 11 is provided with a fourth outer shell 35 having a cylindrical shape, and a flange 36 having an annular shape. The fourth outer shell 35 is formed at the same diameter as the second cylindrical main body 25, and extends toward the first cylindrical member 10 side from the other end of the second cylindrical main body 25 so that the fourth outer shell 35 covers the fourth conical portion 28. The flange 36 is projected to the outside in the radial direction at an end of the fourth outer shell 35 on the first cylindrical member 10 side, and extends in a circumferential direction of the fourth outer shell 35.

The flange 21 of the second outer shell 20 formed at the other end side of the first cylindrical member 10 abuts on the flange 36 of the fourth outer shell 35 formed at the other end side of the second cylindrical member 11, and the flanges 21 and 36 are connected to each other by a double-ended bolt 37, or the like. Thus, the inner cylinder 1 of the present embodiment is formed by arranging each of axes O1 of the first cylindrical member 10 and the second cylindrical member 11 on the same axis, and by connecting the first cylindrical member 10 and the second cylindrical member 11 in series. In addition, the present embodiment shows that, the flanges 21 and 36 of the first cylindrical member 10 and the second cylindrical member 11 are connected to each other by the double-ended bolt 37, however, the flanges 21 and 36 of the first cylindrical member 10 and the second cylindrical member 11 can be connected to each other by welding, for example.

In this case, the second minor diameter portion 16 of the first cylindrical member 10 is inserted into the fourth minor diameter portion 29 having a wavy shape of the second cylindrical member 11, and in a state in which the second minor diameter portion 16 and the fourth minor diameter portion 29 are overlapped along the axis O1, the inner cylinder 1 is formed. Furthermore, the second minor diameter portion 16 is connected to the fourth minor diameter portion 29 via a connection flange 31 formed at an edge of the fourth minor diameter portion 29.

In addition, as shown in FIG. 1 and FIG. 3 showing an enlarged view of a portion S2 in FIG. 1, in the inner cylinder 1 of the present embodiment formed as above, the part formed by the second conical portion 15, the second minor diameter portion 16, and the second outer shell 20 of the first cylindrical member 10; and by the fourth conical portion 28, the fourth minor diameter portion 29, and the fourth outer shell 35 of the second cylindrical member 11 is a connecting part 40 of the first cylindrical member 10 and the second cylindrical member 11. In addition, in an inner surface of the inner cylinder 1, a heat insulation member 41 is provided in a region in which the fixed support 6, details thereof are described later, is provided so as to cover an outer surface of the second conical portion 15 and the second minor diameter portion 16. Furthermore, a heat insulation member 42 covering an outer surface of the fourth conical portion 28 and the fourth minor diameter portion 29 is provided, and this part is a heat insulation part 43 suppressing heat transfer from an inside of the inner cylinder 1 to an outside thereof. That is, the heat insulation part 43 of the present embodiment has the stretchable portion 30, which is configured to be able to stretch in at least a part thereof along the axis O1 of the inner cylinder 1, and has at least two heat insulation members 41, 42 fixed to each of the cylindrical members 10, 11.

In addition, as shown in FIG. 1, the external heating rotary kiln A of the present embodiment is provided with a first outer cylinder 2 and a second outer cylinder 3 (outer cylinders) in which the first cylindrical main body 12 of the first cylindrical member 10 of the inner cylinder 1 is covered by the first outer cylinder 2, and the second cylindrical main body 25 of the second cylindrical member 11 of the inner cylinder 1 is covered by the second outer cylinder 3. The first cylindrical member 10 is heated by causing a heat gas to flow between the first outer cylinder 2 and the first cylindrical main body 12, and the second cylindrical member 11 is heated by causing a heat gas to flow between the second outer cylinder 3 and the second cylindrical main body 25.

Furthermore, in the external heating rotary kiln A of the present embodiment, the inner cylinder 1 and the outer cylinders 2, 3 are disposed on a base 7 by being inclined with a gradient of 1 to 3% so that the outlet port 1*b* side is lower than the inlet port 1*a* side with respect to the horizontal. In addition, in the inner cylinder 1 (and the outer cylinders 2, 3) disposed as above, the first minor diameter portion 14 of the inlet port 1*a* side where the treatment objects are supplied is supported by a first movable support part 4, the third minor diameter portion 27 of the outlet port 1*b* where the treatment objects after heat treatment are discharged is supported by a second movable support part 5, and the connecting part 40 (heat insulation part 43) is supported by the fixed support part 6. That is, the inner cylinder 1 of the present embodiment is supported by a three-point support of a first movable support part 4, a second movable support part 5, and the fixed support part 6, and disposed at a predetermined position.

Figure 5:
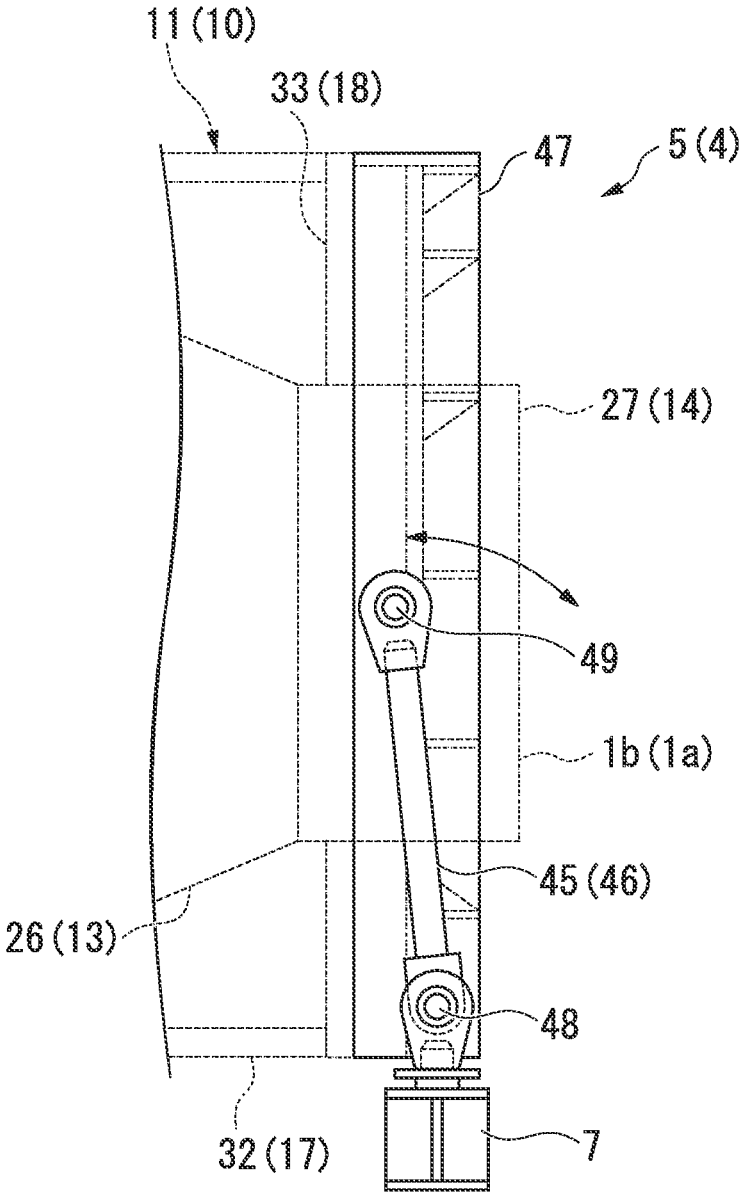
FIG. 5 shows a movable support of the heat treatment apparatus according to one embodiment of the present invention.

The first movable support part 4 and the second movable support part 5, as shown in FIG. 5 (also refer to FIGS. 1, 2, 4), are provided with a pair of movable supports 45, 46 and a support main body 47. The movable supports 45, 46 are installed on the base 7. The lower ends of the movable supports 45, 46 are pivotally supported to the base 7. In the support main body 47, a circular hole in which the first minor diameter portion 14 of the inner cylinder 1 or the third minor diameter portion 27 is inserted is formed so as to penetrate along the axis O1. The upper ends of each of the movable supports 45, 46 pivotally support two side parts, which are spaced away from each other in the radial direction of the inner cylinder 1 of the support main body 47.

In this case, the lower ends of the pair of the movable supports 45, 46 are connected rotatably to the base 7 via a hinge 48, and the upper ends of the pair of the movable supports 45, 46 are connected rotatably to the support main body 47 via a hinge 49. Thus, when the inner cylinder 1 stretches along the axis O1 the support main body 47 supporting the inner cylinder 1 rotates at each of hinges 48, 49, and by moving (displacing) along the axis O1 according to the stretch of the inner cylinder 1, thermal expansion of the inner cylinder 1 caused by heating can be absorbed.

In addition, as shown in FIG. 2 and FIG. 4, a bearing mechanism 50 provided on the support main body 47 and arranged in an annular shape centered to the axis O1 of the insertion hole is provided to the movable support part 4 and the movable support part 5. The first minor diameter portion 14 or the third minor diameter portion 27 of the inner cylinder 1 inserted into the insertion hole is supported by the support main body 47 via this bearing mechanism 50. Thus, the movable support part 4 and the movable support part 5 support the inner cylinder 1 rotatably around the axis O1.

Furthermore, at least one of the movable support part 4 and the movable support part 5 is provided with a rotation driving mechanism (not shown) for rotary driving the inner cylinder 1 around the axis O1. For example, this rotation driving mechanism includes a gear, which is provided to at least one of the first minor diameter portion 14 and the third minor diameter portion 27, a driving motor, and a gear wheel, which is installed to a rotation shaft of the driving motor and is engaged to the gear. Also, the rotation driving mechanism is configured to rotate the inner cylinder 1 around the axis O1 by the driving of the driving motor and the rotation of the gear wheel.

In addition, a feeding device (not shown) such as a screw conveyer for feeding the treatment objects into the inner cylinder 1 is connected to one movable support part 4, and a discharging device (not shown) such as a chute discharging the treatment objects, which were subjected to heat treatment, is connected to the other movable support part 5. In addition, at a connection part connecting the movable support part 4 and the feed device, an expansion joint (not shown) absorbing the displacement along the axis O1 of the movable support part 4 is provided.

Figure 6:
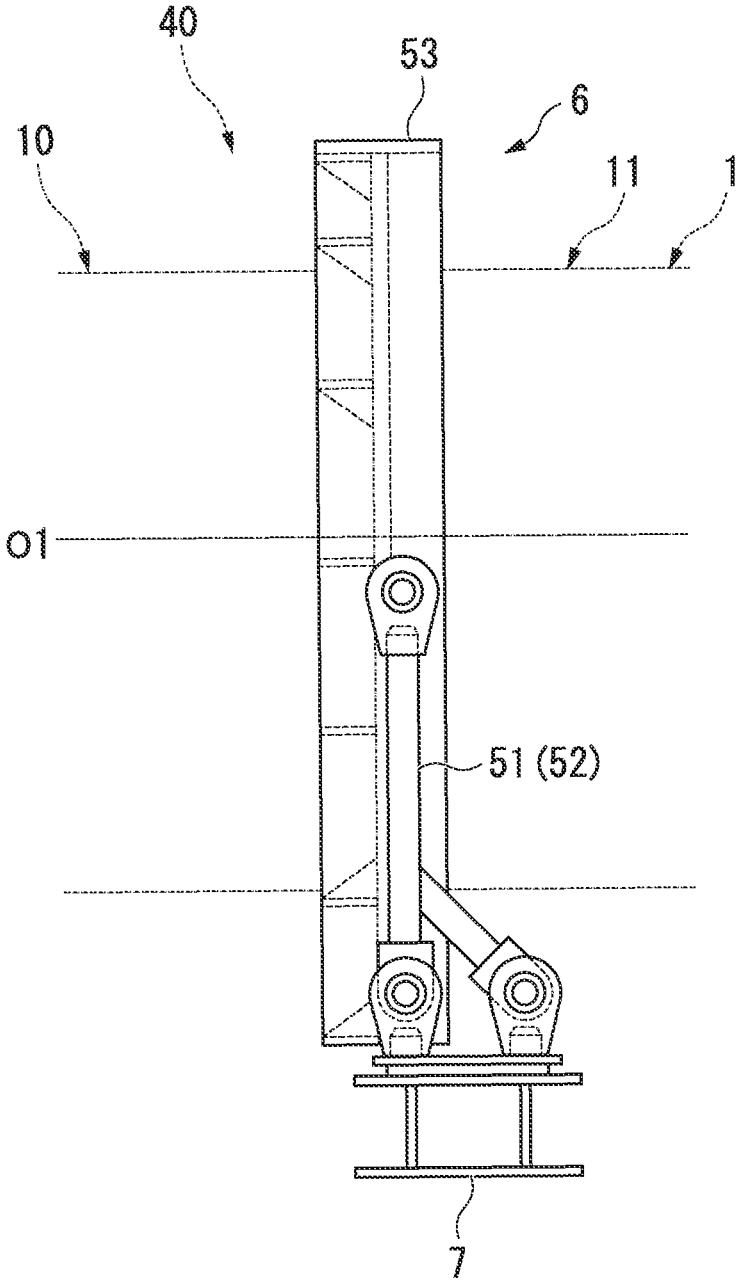
FIG. 6 shows a fixed support of the heat treatment apparatus according to one embodiment of the present invention.

The fixed support part 6, as shown in FIG. 6 (with referring FIG. 1 and FIG. 3), is provided with a pair of fixed supports 51, 52, which are installed on the base 7, and a support main body 53, which is formed so that the insertion hole in a circular shape passing through the connecting part 40 of the inner cylinder 1 penetrates from one surface to the other surface, and which is supported so as to be unable to move along the axis O1 by connecting the pair of the fixed supports 51, 52 to two side parts of the support main body 53. Furthermore, in the support main body 53, the bearing mechanism 50 arranged in an annular shape centered to the axis O1 of the insertion hole is provided, by supporting the connecting part 40 of the inner cylinder 1 inserted into the insertion hole from outside thereof via the bearing mechanism 50, the substantially middle part along the axis O1 of the inner cylinder 1 is supported so as to be unable to move along the axis O1, and is rotatably supported around the axis O1.

In the external heating rotary kiln (heat treatment device) A, when treatment objects which are low calorie materials such as a sewage sludge, a woody biomass and low grade coal are subjected to heat treatment and are reformed to carbide having a large calorific value, the inner cylinder 1 is heated, for example, at 300 to 800° C. by causing a heating gas to flow between the first outer cylinder 2 and the first cylindrical main body 12, and between the second outer cylinder 3 and the second cylindrical main body 25. In addition, when the rotation driving mechanism is driven, the inner cylinder 1, which is supported by the a three-point support of the pair of the movable support parts 4, 5 and the fixed support part 6, rotates around the axis O1 by the bearing mechanism 50. With this, the treatment objects is fed inside the first cylindrical member 10 of the inner cylinder 1 from the inlet port 1*a* by the feeding device, this treatment objects is subjected to heat treatment while sequentially transferring these treatment objects to the second cylindrical member 11 from the first cylindrical member 10, the treatment objects after treatment are discharged to the discharging device and further to the outside from the outlet port 1*b*, and carbide having a large calorific value is produced.

When the treatment objects are subjected to heat treatment as above, thermal expansion is occurred to the inner cylinder 1 by heated at a high temperature of, for example, 300 to 800° C. In the external heating rotary kiln A of the present embodiment, the both ends of the inner cylinder 1 is supported by the movable support parts 4, 5, the middle part of the inner cylinder 1 between a pair of the movable support parts 4, 5 along the axis O1 is supported by the fixed support part 6, and the inner cylinder 1 is supported by a three-point support. Thus, heat expansion that occurs to the first cylindrical member 10 between the one movable support 4 and the fixed support part 6 can be absorbed by the one movable support part 4, and heat expansion that occurs to the second cylindrical member 11 between the other movable support part 5 and the fixed support part 6 can be absorbed by the other movable support part 5.

In addition, in the present embodiment, thermal expansion is absorbed by the movable support parts 4, 5 located at the both ends along the axis O1 of the inner cylinder 1, and further, thermal expansion of the inner cylinder 1 is absorbed by the stretchable part 30 having wavy shape of the heat insulation part 43.

Furthermore, by providing the fixed support part 6 in between the movable support parts 4, 5 of the both ends of the inner cylinder 1, the first cylindrical member 10 of one side of the inner cylinder 1 is supported by the fixed support part 6 and the one movable support part 4, the second cylindrical member 11 of the other side of the inner cylinder 1 is supported by the fixed support part 6 and the other movable support part 5, and the inner cylinder 1 is supported by the three-point support. Thus, even if the length of the inner cylinder 1 is increased in size to approximately 50 m, the amount of bending occurred to the inner cylinder 1 is suppressed to a small amount compared with the two-point support, which supports the inner cylinder 1 at both sides along the axis O1.

Thus, two cylindrical members 10, 11 (an inner cylinder of the conventional external heating rotary kiln) having a length of approximately 20 to 30 m and a diameter of approximately 5 m in which the length and the diameter are compatible in structure and in heat transfer performance of the inner cylinder 1 are connected in series, the connecting part 40 is supported by the fixed support part 6, and both ends of the inner cylinder 1 is supported by the movable support parts 4, 5. Accordingly, even if the inner cylinder 1 is increased in size, the amount of thermal expansion and the amount of bending can be suppressed to a similar extent to the conventional amount. In addition, when the inner cylinder 1 is formed by metals such as austenite or SUS (stainless steel in JIS standard), the amount of thermal expansion and the amount of bending can be surely suppressed to a similar extent to the conventional amount. Also, when the inner cylinder 1 is formed by using alloys such as INCOLOY which causes a large thermal expansion in particular, the amount of thermal expansion and the amount of bending can be reliably suppressed to a similar extent to the conventional amount.

In addition, in the inner surface of the inner cylinder 1, a heat insulation part 43 (heat insulation members 41, 42) suppressing heat transfer from the inside of the inner cylinder 1 to the outside thereof is provided in a region in which the fixed support part 6 is provided. In the present embodiment, by this heat insulation part 43, the outer surface temperature of the second outer shell 20 and the fourth outer shell 35 of the connecting part 40 of the inner cylinder 1 is maintained at a low temperature of, for example, approximately 200° C. Thus, the fixed support part 6, which supports the second outer shell 20 and the fourth outer shell 35 of the connecting part 40 (heat insulation part 43), is not affected by heat transfer, and as this result, the middle part of the inner cylinder 1 can be reliably supported by the fixed support part 6 so as to be unable to move along the axis O1 and so that the inner cylinder 1 is rotatable around the axis O1.

Furthermore, by providing the heat insulation part 43, a lowering of temperature of the inside of the connecting part 40, which supports the inner cylinder 1 by the fixed support part 6, can be minimized. Thus, in the inside of the connecting part 40 of the inner cylinder 1, there is no possibility of a quality loss caused by a lowering of temperature of the treatment objects, and occurrence of problems such as condensation of tar can be reliably prevented.

Therefore, in the external heating rotary kiln (heat treatment apparatus) A of the present embodiment, both ends of the inner cylinder (cylindrical body) 1 are supported by each of the movable support parts 4, 5, the middle part of the inner cylinder 1 which is between the pair of the movable support parts 4, 5 along the axis O1 is supported by the fixed support 6, and the inner cylinder 1 is supported by a three-point support mechanism. Accordingly, heat expansion of the inner cylinder 1 occurred between one movable support part 4 and the fixed support 6 can be absorbed by the one movable support part 4, and heat expansion of the inner cylinder 1 occurred between the other movable support part 5 and the fixed support part 6 can be absorbed by the other movable support part 5.

In addition, by providing the fixed support part 6 in between the movable support parts 4, 5 of the both ends of the inner cylinder 1, one side of the inner cylinder 1 can be supported by the fixed support part 6 and the one movable support part 4, the other side of the inner cylinder 1 can be supported by the fixed support part 6 and the other movable support part 5. Thus, compared with a case of a two-point support, which supports the inner cylinder 1 at both sides along the axis O1, the present invention can suppress the amount of bending that occurs to the inner cylinder 1 to a small amount.

According to the above, for example, two cylindrical members 10, 11 having a length of approximately 20 to 30 m and a diameter of approximately 5 m in which the length and the diameter are compatible in structure and in heat transfer performance of the inner cylinder 1 are connected in series, the connecting part 40 is supported by the fixed support part 6, and both ends of the inner cylinder 1 is supported by the movable support parts 4, 5. Accordingly, even if the inner cylinder 1 is increased in size, the amount of thermal expansion and the amount of bending can be suppressed to a similar extent to the conventional amount. Thus, without changing the thickness of the inner cylinder 1 and without loss of sealing properties, that is, without leading to a decrease in heat transfer performance, the inner cylinder 1 can realize an increase in size.

In addition, according to the external heating rotary kiln A of the present embodiment, the inner cylinder 1 is supported by a three-point support of the pair of the movable support parts 4, 5 and the fixed support part 6, and the present invention solves problems in structure and in heat transfer performance and can realize an increase in size. Thus, the external heating carbonization furnace, or the like, reforming a low-calorie materials of the treatment-objects to carbide having a large calorific value increases an amount of treatment of the treatment objects, can improve the production rate, and can correspond to the needs of large-scale use, such as in coal-fired power plants.

In addition, in the external heating rotary kiln A of the present embodiment, the movable support parts 4, 5 and the fixed support part 6 rotatably support the inner cylinder 1 by the bearing mechanism 50, thereby, by the movable support parts 4, 5 and the fixed support part 6, the influence of heat transfer can be reduced and the inner cylinder 1 can be rotatably supported around the axis O1 reliably.

Furthermore, in the inner surface of the inner cylinder 1, a heat insulation part 43 suppressing heat transfer from the inside of the inner cylinder 1 to the outside thereof is provided in a region in which the fixed support part 6 is provided, thereby the temperature of the outer surface of the inner cylinder 1 can be maintained at a low temperature. Thus, without being affected by the heat transfer, the inner cylinder 1 can be reliably supported by the fixed support part 6.

In addition, however, even if the middle part along the axis O1 of the inner cylinder 1 is supported by the fixed support part 6, by providing the heat insulation part 43, a lowering of temperature of the inside of the inner cylinder 1 at the part, which supports the inner cylinder 1 by the fixed support part 6, can be minimized. Thus, a quality loss of the treatment objects inside the inner cylinder 1 can be suppressed. In addition, a lowering of temperature of the inside of the inner cylinder 1 at the part, which supports the inner cylinder 1 by the fixed support part 6, is suppressed, and thereby a condensation of tar can be prevented and a trouble caused by the lowering of temperature can be reliably avoided.

In addition, the heat insulation part 43 has the stretchable portion 30 which is configured to be able to stretch along the axis O1 in at least part of the heat insulation part 43 along the axis O1, thereby thermal expansion can be absorbed by the movable support parts 4, 5 provided at both ends along the axis O1 of the inner cylinder 1, and thermal expansion of the inner cylinder 1 can be absorbed by the stretchable portion 30 of the heat insulation part 43. Thus, thermal expansion of the inner cylinder 1 can be absorbed more reliably and effectively, and the amount of bending that occurs in the inner cylinder 1 can be suppressed to a small amount.

Furthermore, in the external heating rotary kiln A of the present embodiment, the inner cylinder 1 is configured by two cylindrical members 10, 11 separated into two sections along the axis O1, and the heat insulation part 43 is configured by at least two heat insulation members 41, 42 fixed to each of the cylindrical members 10, 11. Thus, two inner cylinders (cylindrical members 10, 11) of a conventional rotary kiln having a length of approximately 20 to 30 m and a diameter of approximately 5 m in which the length and the diameter are compatible in structure and in heat transfer performance of the inner cylinder 1 are connected in series, and the inner cylinder 1 can be increased in size easily and economically.

In addition, in the external heating rotary kiln A of the present embodiment, the structure inside the connecting part 40 of the first cylindrical member 10 and the second cylindrical member 11 is formed in conical shape, and thereby the heat insulation members 41, 42 can be easily installed in the inside of the second outer shell 20 and the fourth outer shell 35, and even if the fixed support part 6 is provided to the connecting part 40, a quality loss of the treatment objects inside the inner cylinder 1 can be reliably suppressed to a minimum. In addition, the inner cylinder 1 can be easily and economically increased in size by connecting the inner cylinders of a conventional rotary kiln including such conical portions 15, 28 as the cylindrical members 10, 11.

One embodiment of the heat treatment apparatus according to the present invention was explained as described above. However, the present invention is not limited to the configuration of the above described embodiment, but changes can be made without departing from the spirit thereof.

For example, the present embodiment explained that the heat treatment apparatus A is an external heating carbonization furnace; however, the heat treatment apparatus of the present invention is not limited to an external heating carbonization furnace in particular, if the treatment objects of the inside of the cylindrical body 1 can be subjected to heat treatment by heating the cylindrical body 1 rotating around the axis O1. That is, by heating this kind of the cylindrical body 1 rotating around the axis O1, if the apparatus performs heat treatment of the treatment objects inside the cylindrical body 1, the present invention can be applied to, and the same effects and operation as the present embodiment can be obtained.

In addition, in a case where the heat treatment apparatus A is an external heating rotary kiln as the present embodiment, the present embodiment is provided with the outer cylinders 2, 3 covering the inner cylinder (cylindrical member) 1, and the inner cylinder 1 is heated by causing a heating gas to flow between the outer cylinders 2, 3 and the inner cylinder 1. However, for example, the inner cylinder 1 can be heated by an electric heater such as a heating wire, and the method of heating the cylindrical body of the present invention is not required to be limited to the method of the present embodiment.

Furthermore, in the heat treatment apparatus of the present embodiment, the connecting part 40 (heat insulation part 43) is provided with the second conical portion 15, the second minor diameter portion 16, the second outer shell 20, the fourth conical portion 28, the fourth minor diameter portion 29, and the fourth outer shell 35. The second conical portion 15 is formed at the other end of the first cylindrical main body 12 so that the diameter of the second conical portion 15 is gradually reduced from the other end of the first cylindrical main body 12 toward the outer cylinder 3. The second minor diameter portion 16 is formed in a substantially constant diameter with respect to the axis O1 at an end of the second conical portion 15 on the outer cylinder 3 side. The second outer shell 20 is formed to the same diameter as the first cylindrical main body 12, and is formed in a cylindrical shape extending along the axis O1 toward the outer cylinder 3 from the other end of the first cylindrical main body 12 so as to cover the second conical portion 15 and the second minor diameter portion 16. The fourth conical portion 28 is formed at the other end of the second cylindrical main body 25 so that the diameter of the fourth conical portion 28 is gradually reduced from the other end of the second cylindrical main body 25 toward the outer cylinder 2. The fourth minor diameter portion 29 is formed in a substantially cylindrical shape extending along the axis O1 from the fourth conical portion 28 toward the outer cylinder 2 at the end of the fourth conical portion 28 on the outer cylinder 2 side. The fourth outer shell 35 is formed with the same diameter as the second cylindrical main body 25, and is formed in a cylindrical shape extending along the axis O1 toward the outer cylinder 2 from the other end of the second cylindrical main body 25 so as to cover the fourth conical portion 28.

However, for example, the connection part 40 (heat insulation part 43) can be configured in such a manner that the second conical portion 15, the second minor diameter portion 16, the fourth conical portion 28, and the fourth minor diameter portion 29 of the present embodiment are formed to the same diameter as the first cylindrical main body 12 and the second cylindrical main body 25, the second outer shell 20 and the fourth outer shell 35 are formed so that the diameters thereof are gradually increased toward the outside of the inner cylinder along the axis, the heat insulation members 41, 42 are provided inside the connection part 40, and the fixed support part 6 supports the second outer shell 20 and the fourth outer shell 35 from outside.

FIELD OF INDUSTRIAL APPLICATION

According to the heat treatment apparatus of the present invention, both sides of the cylindrical body are supported by each of the movable support parts, the part of the cylindrical body which is between the pair of the movable support parts is supported by the fixed support part, and the cylindrical body is supported by a three-point support mechanism, thereby, by providing the fixed support part in between the two cylindrical bodies, thermal expansion of one side of the cylindrical body and the other side thereof can be absorbed by each of the movable support parts. In addition, compared with a case of a two-point support supporting the cylindrical body at both ends along the axis, the present invention can suppress the amount of bending occurred to the cylindrical body to a small amount. Thus, even if the cylindrical body is increased in size, an increase of the amount of thermal expansion and the amount of bending can be suppressed to a similar extent to the conventional amount, and without leading to the decrease in heat transfer performance, the cylindrical body can realize an increase in size.

DESCRIPTION OF REFERENCE SIGNS

1: inner cylinder (cylindrical body)
1*a*: inlet port
1*b*: outlet port
2: first outer cylinder (outer cylinder)
3: second outer cylinder (outer cylinder)
4: movable support part
5: movable support part
6: fixed support part
7: base
10: first cylindrical member (cylindrical member)
11: second cylindrical member (cylindrical member)
12: first cylindrical main body
13: first conical portion
14: first minor diameter portion
15: second conical portion
16: second minor diameter portion
17: first outer shell
18: first blocking plate
19: heat insulation member
20: second outer shell
21: flange
25: second cylindrical main body
26: third conical portion
27: third minor diameter portion
28: fourth conical portion
29: fourth minor diameter portion
30: stretchable portion
31: connection flange
32: third outer shell
33: second blocking plate
34: heat insulation member
35: fourth outer shell
36: flange
37: double-ended bolt
40: connecting portion
41: heat insulation member
42: heat insulation member
43: heat insulation part
45: movable support
46: movable support
47: support main body
48: hinge
49: hinge
50: bearing mechanism
51: fixed support
52: fixed support
53: support main body
A: external heating rotary kiln (heat treatment apparatus)
L: length of inner cylinder
O1: axis

The invention claimed is:

1. A heat treatment apparatus comprising:

a cylindrical body which is configured by two cylindrical members connected so that treatment objects are capable of being transferred along an axis of the cylindrical body and wherein the cylindrical body is configured to receive treatment objects to be subjected to heat treatment, rotate around the axis and be heated, a pair of movable support parts provided on opposite ends of the cylindrical body along the axis of the cylindrical body so as to be able to move along the axis and rotatably support the cylindrical body around the axis during operation of the apparatus; and a fixed support part provided between the pair of the movable support parts along the axis so as to be unable to move along the axis and rotatably support the cylindrical body around the axis at a connecting part of the two cylindrical members during operation of the apparatus, wherein the cylindrical body is supported by a three-point support formed by the pair of the movable support parts and the fixed support part, wherein each of the two cylindrical members comprises:

a main body which has a first constant diameter, a minor diameter portion which has a second constant diameter smaller than the first constant diameter, and a conical portion which is provided between the main body and the minor diameter portion in which a diameter of the conical portion is gradually reduced from the main body toward the minor diameter portion, wherein the connecting part of the two cylindrical members is configured to connect the two cylindrical members such that the minor diameter portion of each of the two cylindrical members overlap, wherein the cylindrical body includes an outer shell which covers the minor diameter portion and the conical portion of the two cylindrical members at the connecting part of the two cylindrical members, wherein a heat insulation part suppressing heat transfer from an inside of the two cylindrical members to an outside of the outer shell is provided between the two cylindrical members and the outer shell at the connecting part of the two cylindrical members, and wherein at least part of the heat insulation part is disposed along the axis and has a stretchable portion configured to be able to stretch along the axis.

2. The heat treatment apparatus according to claim 1, wherein the movable support parts and the fixed support part rotatably support the cylindrical body with a bearing mechanism.

3. The heat treatment apparatus according to claim 1, wherein the heat insulation part is configured by at least two heat insulation members fixed to each of the cylindrical members.

4. The heat treatment apparatus according to claim 1, wherein the apparatus is an external heating furnace.

5. The heat treatment apparatus according to claim 2, wherein the apparatus is an external heating furnace.

6. The heat treatment apparatus according to claim 3, wherein the apparatus is an external heating furnace.

7. The heat treatment apparatus according to claim 1, wherein each movable support part is provided with a pair of movable supports and a support main body having a circular hole, lower ends of the pair of movable supports are pivotally supported at a base on which the cylindrical body is disposed, and an upper end of a first movable support of the pair of the movable support is pivotally supported at a first part of the support main body, an upper end of a second movable support of the pair of movable supports is pivotally supported at a second part of the support main body, and the first part of the support main body and the second part of the support main body are provided at opposite ends of the cylindrical body with respect to a diameter of the cylindrical body.

* * * * *